United States Patent [19]

Van Tijn

[11] 4,115,992

[45] Sep. 26, 1978

[54] METHOD OF MAKING TEXTURED CONTINUOUS FILAMENT YARN

[75] Inventor: Roeland Van Tijn, Almelo, Netherlands

[73] Assignee: Hollandse Signaalapparaten B.V., Hengelo, Netherlands

[21] Appl. No.: 772,915

[22] Filed: Feb. 28, 1977

Related U.S. Application Data

[62] Division of Ser. No. 695,935, Jun. 14, 1976, abandoned.

[30] Foreign Application Priority Data

Jun. 23, 1975 [NL] Netherlands ..... 7507442

[51] Int. Cl.[2] ..... D02G 3/40

[52] U.S. Cl. ..... 57/164; 57/140 BY

[58] Field of Search ..... 57/160, 162, 164, 140 BY

[56] References Cited

U.S. PATENT DOCUMENTS

| | | | |
|---|---|---|---|
| 2,146,314 | 2/1939 | Radford | 57/149 |
| 3,447,310 | 6/1969 | Bok et al. | 57/164 |
| 3,877,214 | 4/1975 | van der Werf | 57/164 |
| 3,945,186 | 3/1976 | Van Dort | 57/164 X |
| 4,007,580 | 2/1977 | Nijkuis | 57/164 X |

FOREIGN PATENT DOCUMENTS

| | | | |
|---|---|---|---|
| 985,885 | 3/1976 | Canada | 57/164 |

*Primary Examiner*—Charles Gorenstein

*Attorney, Agent, or Firm*—Frank R. Trifari; David R. Treacy

[57] ABSTRACT

A textured continuous filament yarn is obtained by drafting in a wet condition a sliver or a roving, which comprises at least staple fibre material, by combining the thinner fibre strand so obtained with at least one continuous filament to form a filament-fibre blend and by bonding the staple fibres to the continuous filament. The staple fibres may be bonded in a random position to the continuous filament or parallel or substantially parallel to the continuous filament. In the latter case the texture properties become apparent after processing of the yarn into a woven or knitted fabric and finishing such a fabric.

17 Claims, 2 Drawing Figures

METHOD OF MAKING TEXTURED CONTINUOUS FILAMENT YARN

This is a division of application Ser. No 695,935, filed June 14, 1976, now abandoned.

The invention relates to textured continuous filament yarn and to different methods for manufacturing this yarn. Hereinafter the term "texturing" refers to the method by which a smooth or substantially smooth yarn, generally consisting of one or several filaments, is given such a bulky property, after further processing if necessary, that this yarn resembles a spun yarn. The texture properties of the yarn become directly apparent or may not be reflected until the yarn has been processed into a woven or knitted fabric and such a fabric has passed through finishing processes. In the latter case, the yarn contains as it were the texture properties, and the common term applied is textured spun yarn; however, for the sake of clarity the term "textured continuous filament yarn" is used hereinafter.

The increasing use of synthetic continuous filament yarns has given rise to the development of various methods of texturing. With most of these methods a permanent deformation is imparted to smooth filaments, which consequently show a certain crimp and are therewith bulky in appearance. For instance, the British patent specification No. 1,327,273 describes a method of texturing, by which a continuous filament yarn is false twisted and subsequently set in this condition by a heat treatment. The yarn then shows a certain crisp as the false twist tends to untwine. The U.S. Pat. No. 3,822,543 recites a method of texturing, by which fibres grouped around a filament are intertwined through an air or liquid flow.

The method of texturing applied is often shown by the textured continuous filament yarn. However, whatever the method, in all cases, very costly methods and especially developed machines are employed.

It is an object of the present invention to provide a textured continuous filament yarn which may be manufactured relatively cheaply, without the use of special texturing machines.

According to the invention, the textured continuous filament yarn comprises at least one stable continuous filament to which staple fibres are bonded. In order that the term "textured yarn" be still applicable, it stands to reason that the continuous filament part of the yarn should constitute at least half the yarn weight per unit of length. It will hereafter be made clear that such textured continuous filament yarn can be manufactured analogously to certain conventional methods for the production of twistless yarns, and that the machines used for the manufacture of the latter yarns can also be employed for the texturing of continuous filaments.

First the methods of bonding the staple fibres to a continuous filament will be described.

1. The basic material used is a sliver or roving which consists of staple fibre material containing at least two components, at least one of which is potentially adhesive and provides for the bonding of the remaining staple fibre material to the stable continuous filament. The staple fibre material may be:

a. bi- or multi-component fibres (hereinafter referred to in the specification and claims as multi-component fibres);

b. a blend of different kinds of staple fibres.

The potentially adhesive component of the multi-component fibres and the potentially adhesive fibre component of the above blend are swellable, gelatinisable or soluble in water or suitable organic solvents, preferably under an increased temperature. As described below, potentially adhesive components have the property that they can be, and usually are, removed from finished fabric made from yarns having such a component. The sliver or roving is drafted in a wet condition and the thinner fibre strand so obtained is added to at least one continuous filament to form a filament-fibre blend. This blend may be realized by the use of separate feedthrough rollers or the last rollers of the draw frame used for the sliver or roving. To ensure that the process in question proceeds reliably, it is preferable to false twist the filament-fibre blend and to add, if necessary, more liquid. During and/or after these processes the potentially adhesive component in the filament-fibre blend can be activated. Then the bonding of the staple fibres to the filament is completed by drying the blend.

2. The basic material used is a silver or roving, consisting of staple fibres, which are drafted in a wet condition to a thinner fibre strand. The fibre strand is added to at least one continuous filament to form a filament-fibre blend. Suitable filaments are:

a. multi-component filaments which includes, similarly to multi-component fibres, bi-component filaments;

b. a blend of different kinds of continuous filaments.

The potentially adhesive component of the multi-component filaments and the potentially adhesive filament component of the filament-fibre blend are swellable, gelatinizable or soluble in water or in suitable organic solvents, preferably under an increased temperature. The staple fibres and the continuous filament may be assembled by the use of separate feedthrough rollers or the last rollers of the draw frame used for the sliver or roving. As under 1. above, it is preferable to false twist the filament-fibre blend and to add, if necessary, more liquid. Again, during and/or after these processes the potentially adhesive component in the filament-fibre blend can be activated. Thereafter the bonding of the staple fibres to the stable filament component is completed by drying the blend.

3. The basic material used is a sliver or roving consisting of staple fibre material, to which a potentially adhesive filament soluble in water is added. The whole is wetted in such a way that the potentially adhesive filament assumes a strongly plasticized state in order to be drafted together with the sliver or the roving to a thinner fibre strand. With the aid of separate feedthrough rollers or with the last rollers of the draw frame this fibre strand is combined with at least one stable continuous filament to form a filament-fibre blend. This blend contains the strongly plasticized potential adhesive already activated prior to the drafting, to produce the textured filament yarn after drying. Only in this case does, the sliver or the roving contain materials other than staple fibre material exclusively. In the other cases described, the sliver or the roving comprises exclusively staple fibres.

4. The basic material used is a sliver or a roving consisting of staple fibres, which are drafted in a wet condition to a thinner fibre strand. With the aid of separate feedthrough rollers or with the last rollers of the draw frame used for the sliver or the roving this fibre strand is combined with at least one stable continuous filament to form a filament-fibre blend. In order to bond the staple fibres to the continuous filament, an adhesive suspension or solution is added as follows:

a. to the sliver or the roving before and/or during the wet-drafting;
b. to the continuous filament;
c. to the filament-fibre blend after the combination of the staple fibres and the continuous filament.

In all of the three cases above, both an active and an inactive adhesive may be employed. Again, to ensure a reliable process, the filament-fibre blend is false twisted. In case an active adhesive is used, the bonding of the staple fibres to the continuous filament is completed by the drying of the filament-fibre blend. If however an inactive adhesive is applied, this adhesive is activated during and/or after the false-twisting and, if necessary, the addition of more liquid. The bonding of the staple fibres to the stable filament is subsequently completed by drying of the filament-fibre blend.

5. The basic material applied is a sliver or a roving consisting of staple fibres, which are drafted in a wet condition to a thinner fibre strand. With the aid of separate feedthrough rollers or with the last rollers of the draw frame used for the sliver or the roving this fibre strand is combined with at least one stable continuous filament to form a filament-fibre blend. The bonding of the staple fibres to the continuous filament is realized here by the application of a latent solvent which is activated by heating. As in the case of the adhesive suspension or solution, the latent solvent may be added as follows:

a. to the sliver or the roving before and/or during the wet-drafting;
b. to the continuous filament;
c. to the filament-fibre blend after the combination of the staple fibres and the continuous filament.

The filament-fibre blend is again false twisted; subsequently, the surface of the continuous filament and/or the staple fibres is dissolved (partially) by heating the latent solvent. The bonding of the staple fibres to the continuous filament is completed when the solvent has evaporated through the partial dissolving of the fibres and/or the filaments under an increased temperature, such that no or hardly any solvent is left in the textured yarn.

As briefly mentioned in 1, 2 and 3 above, the texturing process is analogous to the method for the manufacture of twistless yarn, described in the Dutch Pat. Nos. 144,678, 144,679 and 147,198, to which Canadian Pat. Nos. 960,828, 985,885, and 986,676 correspond. Insofar as inactive adhesive is used, the texturing process, as stated in 4 above, is similar to the method for the manufacture of yarn, as described in the Dutch Pat. No. 143.002, to which Canadian Pat. No. 836,280 corresponds. The latter patent specification also mentions that, in the present state of the art, a high production rate is achieved through the drafting in a wet condition, applied in all of the four texturing processes. This stresses the practical need to employ a false twisting unit. The reasons why additional liquid may have to the applied after the false twisting are explained in detail in the Dutch Pat. application No. 74.06030, and the corresponding copending U.S. application Ser. No. 570,729 assigned to the assignee of this application. The Dutch patent application No. 74.11139, and the corresponding copending U.S. application Ser. No. 598,013 assigned to the assignee of this application, refers to a false twisting unit, permitting the supply of additional liquid directly after the false twisting process. The drafting in a wet condition may be realized by using the draw frame referred to in the Dutch patent application No. 74.04653, and the corresponding copending U.S. application Ser. No. 558,316 assigned to the assignee of this application while the activation may be implemented as described in the Dutch Pat. No. 144.679 (and corresponding Canadian Pat. No. 985,885) and No. 147.491 or in the Dutch patent application No. 75.01535, and the corresponding copending U.S. application Ser. No. 649,706 assigned to the assignee of this application. From the above it is seen that the texturing process may be performed analogously to the method for the manufacture of twistless yarn, as described in the above-mentioned patent specifications and patent applications.

Although the drafted staple fibre material, after combination with the continuous filament, lies in principle in the longitudinal direction of this filament, it can be achieved that, owing to the use of a false twisting unit, the staple fibres are bonded in a rather random position to the continuous filament. In such a case the textured yarn readily has a fibrous appearance. If the staple fibres are bonded substantially parallel to the longitudinal direction of the continuous filament the yarn does possess the texture properties, but these will not be clearly evident until after the processing of the yarn into a woven or knitted fabric and, if applicable, after finishing of such a fabric, from which the adhesive component has been removed. Unless a solvent is used for the bonding of the staple fibres to the stable continuous filament, the textured yarn will contain the component that provided for the bonding, in addition to the continuous filament and staple fibres bonded thereto. This component is usually removed with the finishing of a woven or knitted fabric produced by this yarn.

DESCRIPTION OF THE PREFERRED EMBODIMENTS

Figure 1:
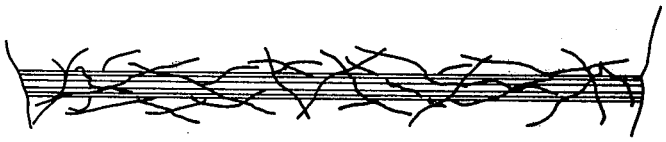
FIG. 1 is a view of a textured yarn having staple fibres bonded in random positions.
Figure 2:
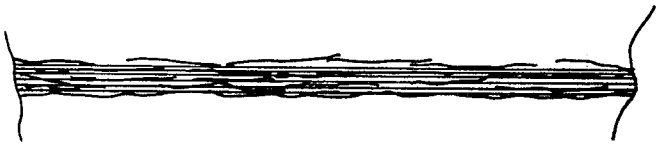
FIG. 2 is a view of a textured yarn having staple fibres bonded substantially parallel to stable filaments.

With the application of the texturing methods in 1, 2 and 3 above, both staple fibres and continuous filaments can be taken as material not providing for the bonding. This material may consist of:

a. natural silk;
b. artificial staple fibres or continuous filaments, such as viscose rayon, cellulose di- and tri-acetate;
c. synthetic fibres and/or continuous filaments, such as polyamide, polyester, polyacrylonitrile or stabilized polyvinyl alcohol.

Furthermore, such material may consist of staple fibres only, viz natural cellulose fibres, such as cotton and flax, and protein fibres, such as wool and hair. The component providing for the bonding may be:

a. unstabilized polyvinyl alcohol consisting of either staple fibres or continuous filaments, in which case warmed water is used for the activation;
b. alginate fibres, which are usually activated in water at room temperature or slightly above room temperature;
c. cellulose di- and tri-acetate fibres, which are activated in an organic solvent, such as acetone, formic acid and acetic acid.

If multi-component fibres or continuous multi-component filaments are used, at least including, as defined above, bi-component fibres and bi-component filaments, a part of the fibre or filament surface is to be potentially adhesive. A suitable material is for example a fibre and/or a filament with a core of stabilized polyvinyl alcohol surrounded by a layer of unstabilized polyvinyl alochol.

With the texturing method in four above, the material not providing for the bonding may be the same as that used with the methods described in one, two and three above. As already indicated, the staple fibres can be bonded to the stable continuous filament by either an inactive or active adhesive. For example, a starch suspension may be used as an inactive adhesive, and a polyvinyl alcohol solution as an active adhesive.

With the texturing method described in five, polyacrylonitrile, modified polyacrylonitrile, cellulose di- or tri-acetate or polyvinyl chloride may be used, provided that sulpholane or a blend of sulpholane and an organic solvent is used as latent solvent. Sulpholane is here considered to be unsubstituted sulpholane (tetramethylene sulphone) and substituted sulpholane, such as 2-methyl sulpholane, 3-butyl sulpholane, 3-idopropyl sulpholane, 3-n-hexyl sulpholane, 2-methyl-4-butyl sulpholane and 3-cyclohexyl sulpholane. Suitable organic solvents, required when using modified polyacrylonitrile, are for example: diethylene glycol, triethylene glycol, dibutyl phthalate, triethanolamine, 3-octyl sulpholanyle ether, trichloropropyl phosphate, alcohol alkoxylate and glycol alkoxylate. Furthermore, polyester or polyamide can be used for the texturing, if the latent solvent applied is chlorated diphenyl ether, preferably 2-hydroxy-4,2',4'-trichlorodiphenyl ether. The working and the properties of the solvents mentioned above are described in detail in the British patent specifications Nos. 993,498 and 1,362,615 and the U.S. Pat. No. 3,734,799, while the application of these solvents for the manufacture of twistless yarn is described in the Dutch patent application No. 75,04728,and the corresponding copending U.S. application Ser. No. 673,405 assigned to the assignee of this application.

It is to be noted that various other chemical substances, such as plasticizers, corrosion inhibitors, fireproofing agents, dyes and antistatic agents, can be added to the liquid used for wet-drafting.

EXAMPLE 1

A 30-filament viscose rayon yarn having a titre of 130 dtex was textured with a blend of 89% rayon fibres (AKZO Colvera H.W.M., having a titre of 1.65 dtex and a staple length of 40 mm) and 11% unstabilized polyvinyl alcohol fibres (type Unitika SMA3, having a titre of 1.65 dtex and a staple length of 40 mm) to form a textured yarn having a titre of 245 dtex and comprising 53.3% viscose rayon filament, 41.5% rayon fibres and 5.2% unstabilized polyvinyl alcohol.

The basic material was a roving having a titre of 290 tex and consisting of 89% rayon fibres and 11% unstabilized polyvinyl alcohol fibres. This roving was drafted in a wet condition with a draw ratio of 25. The staple fibres and the filament were combined at the last rollers of the draw frame. The filament-fibre blend thus obtained was then false twisted and the unstabilized polyvinyl alcohol contained therein was activated in a 30 cm long steam pipe. Finally, the filament-fibre blend was dried on a drum heated to 180° C. The texturing rate was 250 m/min.

Prior to the texturing the bulkiness of the viscose rayon filament was 1.545 $cm^3/gm$; the bulkiness of the textured yarn was 2.349 $cm^3/gm$. Furthermore, the breaking strength of the textured yarn was 11.8 gm/tex and the breaking elongation 6.4%.

EXAMPLE 2

An acryl filament yarn (type X-100 Dralon of Bayer AG with a titre of 140 dtex and consisting of 15 filaments) was textured with 1.5 denier acryl fibres having a staple length of 40 mm to form a textured yarn of 282 dtex.

The basic material was a roving of 355 tex consisting of acryl fibres. This roving was wetted, using a solution of 10% sulpholane (Shell Bondolane A) in water, and then wet drafted, the drafting ratio being 25. The staple fibres and the filament were combined at the last rollers of the draw frame; the filament-fibre blend so obtained was false twisted and passed over a drum heated to 130° C. Under these conditions the water was evaporated and the sulpholane was activated, while the bonding was realized by partially solving the fibres and the filaments under evaporation of the sulpholane. The texturing rate was 200 m/min.

Prior to the texturing the bulkiness of the acryl filament was 1.754 $cm^3/gm$; the bulkiness of the textured yarn was 3.765 $cm^3/gm$.

Furthermore, the breaking strength of the textured yarn was 20.6 gm/tex and the breaking elongation 10.0%.

Finally, it is remarked that the principle applied in conducting the bulkiness measurements is described in "Rayon Revue," Volume IX, July 3, 1955. A further description of the method used in performing these measurements is given in "Report No. 63, September 1956" of the TNO Fibre Institute.

What we claim is:

1. Method for the manufacture of textured continuous filament yarn from a sliver or a roving comprising at least staple fibre material, comprising the steps of drafting said sliver or roving in a wet condition to form a thinner fibre strand, combining the wet thinner fibre strand so drafted with at least one stable continuous filament to form a filament-fibre blend, and then bonding the staple fibres to the continuous filament, wherein the sliver or roving includes an at least potentially adhesive first component, said component bonding said staple fibres to said at least one filament during the bonding step.

2. Method for the manufacture of textured continuous filament yarn as claimed in claim 1, wherein the sliver or roving consists of staple fibre material that contains at least two components, of which one is said first component and is potentially adhesive, said first component providing for bonding of the remaining staple fibre material to the continuous filament; and bonding comprises activating the adhesive component and drying of the filament-fibre blend.

3. Method for the manufacture of textured continuous filament yarn as claimed in claim 2, wherein said staple fibre material comprises multi-component fibres, a component of said multi-component fibres being said first component.

4. A method for the manufacture of textured continuous filament yarn as claimed in claim 2, wherein said remaining staple fibre material consists of stable fibres.

5. Method for the manufacture of textured continuous filament yarn as claimed in claim 1, wherein said first component consists of at least one potentially adhesive continuous filament soluble in water, and said sliver or roving consists of staple fibre material combined with said potentially adhesive filament, wetted to such an extent that the continuous filament is at least in a plastic state so as to enable drafting of the sliver or roving to a thinner fibre strand, said fibre strand being combined with said at least one continuous filament and bonded by subsequent drying.

6. Method for the manufacture of textured continuous filament yarn from a sliver or a roving comprising at least staple fibre material, comprising the steps of drafting said sliver or roving in a wet condition to form a thinner fibre strand, combining the wet thinner fibre strand so drafted with at least one stable continuous filament to form a filament-fibre blend, and then bonding the staple fibres to the continuous filament, wherein said sliver or roving consists of staple fibre material, and said at least one filament contains at least one potentially adhesive component providing for the bonding of the staple fibres to the stable filament, which bonding is realized by the activation of the adhesive component and the drying of the filament-fibre blend.

7. Method for the manufacture of textured continuous filament yarn as claimed in claim 6, wherein said at least one filament containing at least one adhesive component is a multi-component filament.

8. Method for the manufacture of textured continuous filament yarn as claimed in claim 6, wherein said thinner fibre strand is combined with a plurality of filaments to form a filament-fibre blend, at least one of said plurality of filaments being an adhesive component.

9. Method for the manufacture of textured continuous filament yarn from a sliver or a roving comprising at least staple fibre material, comprising the steps of drafting said sliver or roving in a wet condition to form a thinner fibre strand, combining wet thinner fibre strand so drafted with at least one stable continuous filament to form a filament-fibre blend, and then bonding the staple fibres to the continuous filament, comprising the additional step of adding a latent solvent in the course of the process, wherein the sliver or roving consists of staple fibre material, said fibre strand and said at least one stable continuous filament are respective first and second portions of said filament-fibre blend, and said bonding step includes activating said latent solvent by heating such that at least one of said portions are solved and said portions are subsequently bonded to each other at their points or contact, while the solvent is removed from the filament-fibre blend by evaporation.

10. Method for the manufacture of textured continuous filament yarn as claimed in claim 9, wherein the latent solvent is added to the sliver or roving prior to completion of the drafting in a wet condition.

11. Method for the manufacture of textured continuous filament yarn as claimed in claim 9, wherein the latent solvent is added by applying it to the continuous filament prior to said combining step.

12. Method for the manufacture of textured continuous filament yarn as claimed in claim 9, wherein the latent solvent is added to the filament-fibre blend after said combining step.

13. Method for the manufacture of textured continuous filament yarn from a sliver or a roving consisting of staple fibre material, comprising the steps of drafting said sliver or roving in a wet condition to form a thinner fibre strand, combining the wet thinner fibre strand so drafted with at least one stable continuous filament to form a filament-fibre blend, adding an active adhesive in the course of the process for bonding the filament-fibre blend, and then bonding the staple fibres to the continuous filament by drying.

14. Method for the manufacture of textured continuous filament yarn as claimed in claim 13, wherein the adhesive is added to the continuous filament.

15. Method for the manufacture of textured continuous filament yarn from a sliver or a roving consisting of staple fibre material, comprising the steps of drafting said sliver or roving in a wet condition to form a thinner fibre strand, adding an adhesive prior to completion of the drafting in a wet condition, combining the wet thinner fibre strand so drafted with at least one stable continuous filament to form a filament-fibre blend and then bonding the staple fibres to the continuous filament.

16. Method for the manufacture of textured continuous filament yarn from a sliver or roving consisting of staple fibre material, comprising the steps of drafting said sliver or roving in a wet condition to form a thinner fibre strand, combining the wet thinner fibre strand so drafted with at least one stable continuous filament to form a filament-fibre blend, then adding an adhesive to the filament-fibre blend, and then bonding the staple fibres to the continuous filament.

17. Method for the manufacture of textured continuous filament yarn as claimed in claim 16, wherein the adhesive is added in an inactive state and the filament-fibre blend is bonded by subsequent activation of the adhesive and drying of the filament-fibre blend.

* * * * *